US010463115B2

(12) United States Patent
Hawkins et al.

(10) Patent No.: US 10,463,115 B2
(45) Date of Patent: Nov. 5, 2019

(54) ATTACHMENT DEVICE

(71) Applicant: NIKE, Inc., Beaverton, OR (US)

(72) Inventors: Sherry D. Hawkins, Kalama, WA (US); HoonJoo Lee, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 170 days.

(21) Appl. No.: 15/629,946

(22) Filed: Jun. 22, 2017

(65) Prior Publication Data

US 2018/0008009 A1 Jan. 11, 2018

Related U.S. Application Data

(60) Provisional application No. 62/359,480, filed on Jul. 7, 2016.

(51) Int. Cl.

| | |
|---|---|
| ***A44B 17/00*** | (2006.01) |
| ***A45F 5/02*** | (2006.01) |
| *A45C 13/10* | (2006.01) |
| *A45C 13/12* | (2006.01) |
| *A45C 11/00* | (2006.01) |

(52) U.S. Cl.

CPC ..... *A44B 17/0023* (2013.01); *A44B 17/0041* (2013.01); *A45F 5/02* (2013.01); *A45C 13/1092* (2013.01); *A45C 13/123* (2013.01); *A45C 2011/002* (2013.01); *A45F 2200/0516* (2013.01)

(58) Field of Classification Search

CPC ..... Y10T 24/13; Y10T 24/1394

See application file for complete search history.

(56) References Cited

U.S. PATENT DOCUMENTS

| | | | |
|---|---|---|---|
| 1,452,052 | A | 4/1923 | Nalle |
| 2,203,017 | A | 6/1940 | Illsche |

(Continued)

FOREIGN PATENT DOCUMENTS

| | | | |
|---|---|---|---|
| FR | 2855951 | A1 | 12/2004 |
| WO | WO-2014071186 | A1 | 5/2014 |

OTHER PUBLICATIONS

European Patent Office (ISA), International Preliminary Report on Patentability for Application No. PCT/US2017/039002, dated Jan. 17, 2019.

(Continued)

*Primary Examiner* — Jason W San

(74) *Attorney, Agent, or Firm* — Honigman LLP; Matthew H. Szalach; Jonathan P. O'Brien

(57) ABSTRACT

An attachment apparatus for selectively attaching a device to a flexible material, includes a first member, a second member, and a void. The first member has a first wall defining a first opening. The first member includes a first retention feature. The second member has a second retention feature selectively attached to the first retention feature in an attached state to connect the second member to the first member and to the flexible material. The void is formed between the second surface of the first wall and the flexible material when the second member is in the attached state. The first member is operable to support the device within the void between the second surface of the first member and the flexible material when the second member is in the attached state.

27 Claims, 11 Drawing Sheets

(56) References Cited

U.S. PATENT DOCUMENTS 2,807,804 A * 10/1957 Miller ..... A41D 15/00 2/126
3,401,434 A * 9/1968 Daddona, Jr. ..... A44B 17/0029 24/689
3,449,802 A 6/1969 Mackey
4,253,226 A * 3/1981 Takeda ..... A44B 17/0035 24/691
4,705,086 A 11/1987 O'Neill
5,033,170 A 7/1991 Ewert
5,381,588 A * 1/1995 Nelson ..... B65D 73/0064 24/30.5 S
5,490,309 A 2/1996 Velasquez et al.
5,610,877 A 3/1997 Adams et al.
5,644,799 A * 7/1997 Armenta ..... A42B 1/225 132/273
5,940,942 A 8/1999 Fong
6,161,263 A * 12/2000 Anderson ..... A41B 11/002 24/30.5 S
6,442,808 B2 * 9/2002 Fildan ..... A41C 3/00 2/265
7,013,539 B2 * 3/2006 Fildan ..... A44B 17/0035 2/265
7,519,192 B1 * 4/2009 Laycock ..... A41D 1/005 381/301
7,752,718 B2 * 7/2010 Fisher ..... A44B 17/0035 24/114.4
8,327,510 B2 * 12/2012 Schlesinger ..... A41F 17/02 2/269
8,935,835 B2 * 1/2015 Fildan ..... A41F 1/002 24/303
D729,041 S * 5/2015 Smith ..... D8/349
9,568,144 B2 * 2/2017 Pernu ..... F16M 11/041
9,918,541 B2 * 3/2018 Byun ..... A45F 5/02
9,943,121 B2 * 4/2018 Gellineau ..... A41D 1/002
10,165,811 B2 * 1/2019 O'Leary ..... A41D 27/08
2004/0055120 A1 3/2004 Gillis
2006/0005361 A1 * 1/2006 O' Banion ..... A42B 1/24 24/303
2006/0048345 A1 * 3/2006 Hasegawa ..... A44B 17/0005 24/104
2006/0182297 A1 * 8/2006 Cyr ..... A41D 1/005 381/333
2007/0245444 A1 * 10/2007 Brink ..... A41D 1/005 2/69
2008/0256759 A1 * 10/2008 Kasbohm ..... B65F 1/06 24/30.5 S
2010/0115732 A1 * 5/2010 Honeycutt ..... H04R 5/0335 24/3.3
2011/0204108 A1 8/2011 Manley
2012/0079687 A1 * 4/2012 Ingram ..... A45F 5/02 24/3.1
2014/0013545 A1 1/2014 Pernu et al.
2014/0033394 A1 * 2/2014 Stauffer ..... H01F 7/0263 2/69
2014/0159840 A1 * 6/2014 Qadri ..... H04B 1/3888 335/285
2015/0374056 A1 * 12/2015 Gheneva ..... A41D 27/205 2/85

OTHER PUBLICATIONS

European Patent Office (ISA), International Search Report and Written Opinion for Application No. PCT/US2017/039002, dated Sep. 20, 2017.

* cited by examiner

ATTACHMENT DEVICE

CROSS REFERENCE TO RELATED APPLICATION

This application claims priority to U.S. Provisional Application Ser. No. 62/359,480, filed Jul. 7, 2016, the disclosure of which is hereby incorporated by reference in its entirety.

FIELD

The present disclosure relates to an attachment device for attaching a device to a flexible material and more particularly to an attachment device for attaching a personal mobile device to an article of clothing.

BACKGROUND

This section provides background information related to the present disclosure and is not necessarily prior art.

In recent years, the use of personal mobile devices, such as smartphones, portable media players, digital video cameras, and personal navigation assistants (PNA) has grown exponentially. One of the reasons for the growth of personal mobile devices is that a user is able to carry these devices from place to place, freeing the user from being connected to a fixed communication network.

Typically, a user carries a personal mobile device in a purse, briefcase, or in his/her pocket. However, by putting the personal mobile device in a purse, briefcase, or pocket, the personal mobile device may not be readily accessible to the user. Further, carrying a personal mobile device in the foregoing manner is generally not possible during physical activity such as during an athletic event. Even if carrying a personal mobile device during an athletic event such as, for example, running or lifting weights, is possible, carrying the personal mobile device may hinder the athlete's performance.

While personal mobile devices adequately provide a user with on-demand music, video, data, and/or cellular phone service, such devices require a user to carry the device during use. As such, use of personal mobile devices during physical activity such as during an athletic activity can be challenging.

DESCRIPTION OF DRAWINGS

A system of the present disclosure implements an application recommendation system based on a user's usage data.

Like reference symbols in the various drawings indicate like elements.

DETAILED DESCRIPTION

Figure 1:
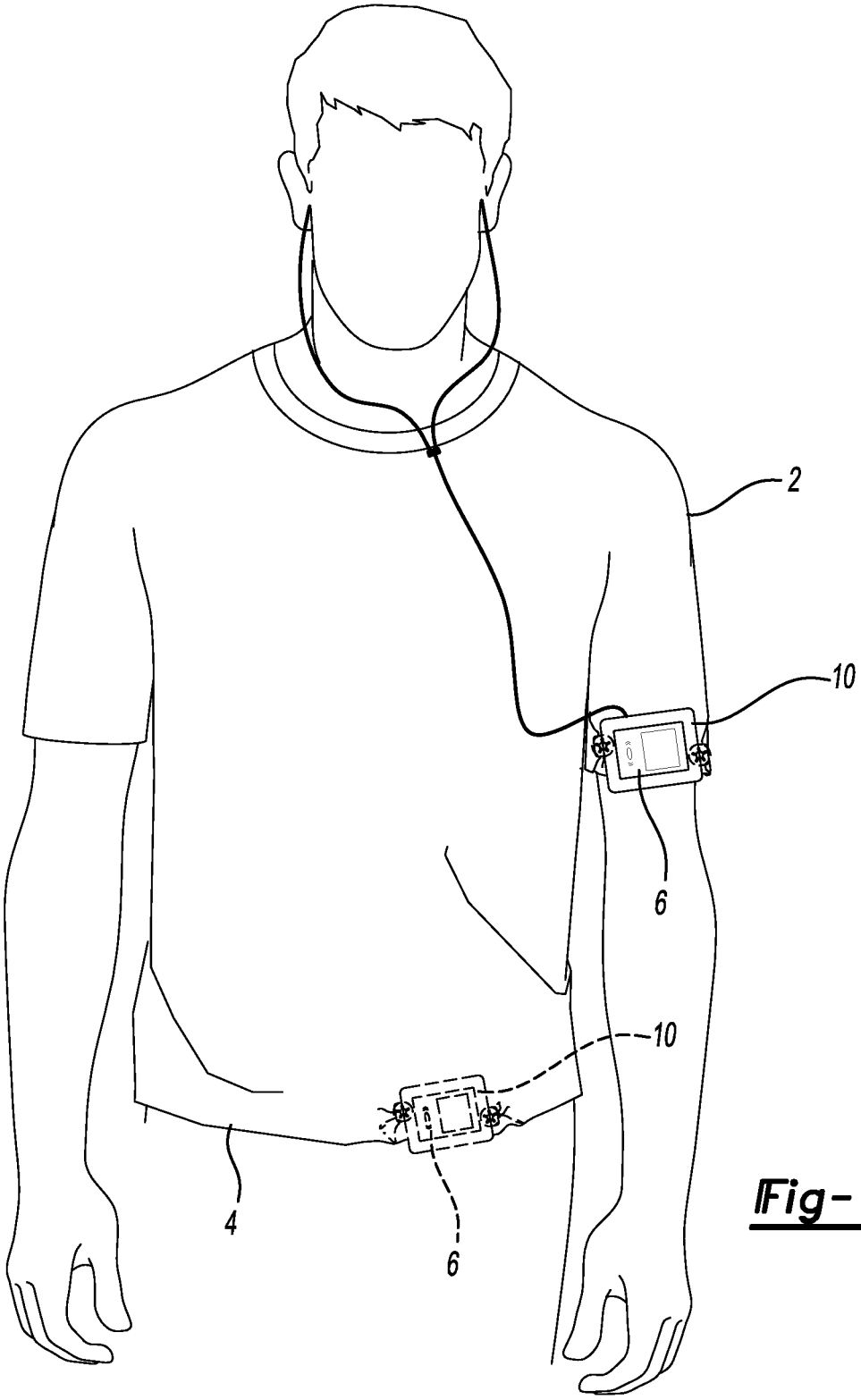
FIG. 1 is a schematic view of an attachment device attached to a flexible material worn by a user.
Figure 2:
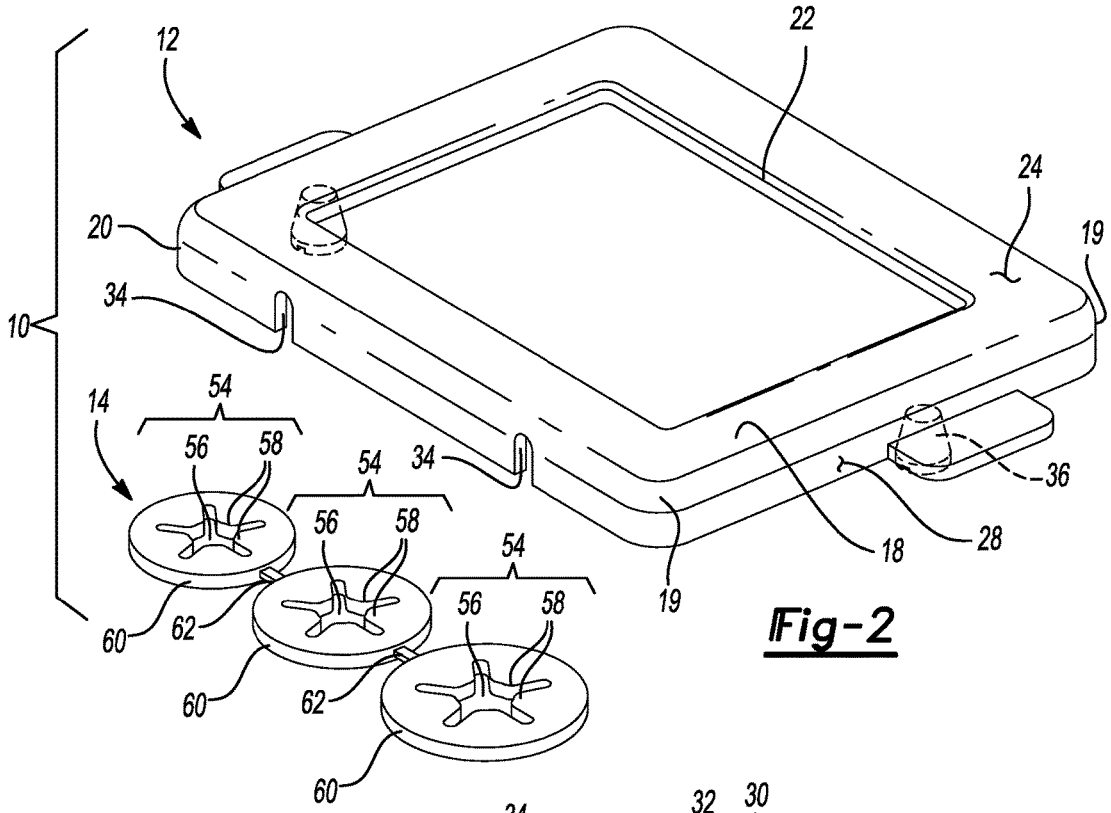
FIG. 2 is a front perspective view of the attachment device of FIG. 1.

Example configurations will now be described more fully with reference to the accompanying drawings. Example configurations are provided so that this disclosure will be thorough, and will fully convey the scope of the disclosure to those of ordinary skill in the art. Specific details are set forth, such as examples of specific components, devices, and methods, to provide a thorough understanding of configurations of the present disclosure. It will be apparent to those of ordinary skill in the art that specific details need not be employed that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as, "first," "second," and other numerical terms do not imply a sequence or order unless clearly indicated by the context. Thus, a first element, component, region, layer or section discussed below could be termed a second element, component, region, layer or section without departing from the teachings of the example configurations.

With reference to the figures, an attachment apparatus for selectively attaching a device, such as a smartphone or a portable audio player, for example, to a flexible material, is provided and may include a first member, a second member, and a void. The first member may have a first wall that defines a first opening and includes a first surface and a second surface formed on an opposite side of the first wall than the first surface. The first member may include a first projection that extends in a direction away from the second surface and includes a first retention feature. The first member may have a first wall defining a first opening and including a first surface and a second surface formed on an opposite side of the first wall than the first surface. The first member may include a first projection that extends in a direction away from the second surface. The first member may include a first retention feature. The second member may have a second retention feature selectively attached to the first retention feature in an attached state to connect the second member to the first member and to the flexible material. The void may be formed between the second surface of the first wall and the flexible material when the second member is in the attached state and operable to receive the device therein. The first member may be operable to support the device within the void between the second surface of the first member and the flexible material when the second member is in the attached state.

In one configuration, the first projection is operable to extend a portion of the flexible material into the second member in the attached state. The first member may include at least one positioning feature operable to position the device relative to the first opening when the second member is in the attached state. The at least one positioning feature may include a tab that extends from the second surface of the first member and is operable to engage the device to urge the device toward the flexible material.

In one configuration, the first projection includes a first end attached to the first member and a second end disposed at a distal end of the first projection. The second end may have a different cross-section than the first end and defines the first retention feature. The second end may be movable between a compressed state and an expanded state. The second end may be moved into the compressed state when the first projection passes through the second member and may be moved into the expanded state after passing through the second member. The second end may be biased into the expanded state. The second member may be disposed between the first end of the first projection and the second end of the first projection in the attached state. The cross-section of the second end of the first projection may include at least one of a different size and shape than the first end of the first projection.

In one configuration, the first member is disposed on an opposite side of the flexible material than the second member when the second member is in the attached state. The second retention feature may include a second opening and at least one tab extending into the second opening. The second opening may receive the first projection therein in the attached state. The at least one tab may engage the first retention feature in the attached state to maintain the second member in the attached state.

In one configuration, the flexible material is disposed between the first projection and the at least one tab when the second member is in the attached state. The attachment apparatus may further include a second projection extending in a direction away from the second surface. The second projection may be operable to be attached to another second member in an attached state to secure the first member to the flexible material.

In another configuration, an attachment apparatus for selectively attaching a device, such as a smartphone or a portable audio player, for example, to a flexible material, is provided and may include a first member, a second member, and a void. The first member may have a first wall that includes a first surface and a second surface formed on an opposite side of the first wall than the first surface. The second wall may extend from the second surface and may include an engagement surface. The second member may be selectively attached to the first member in an attached state to connect the second member to the first member and to the flexible material. The void may be bounded by the second surface of the first wall, the second wall, and the flexible material when the second member is in the attached state. The engagement surface may be in contact with the flexible material. The first member may be operable to support the device within the void when the second member is in the attached state.

In one configuration, the first member positions a portion of the flexible material within the second member when the second member is in the attached state to attach the first member and the second member to the flexible material. The first member may include at least one positioning feature operable to position the device relative to the first member when the second member is in the attached state. The at least one positioning feature may include a tab extending from the second surface of the first member and operable to engage the device to urge the device toward the flexible material.

The first member may include a first projection that extends from the second surface. The first projection may include a first end attached to the first member and a second end disposed at a distal end of the first projection. In addition, the second end may have a different cross-section than the first end and may define a first retention feature. The second end may be movable between a compressed state and an expanded state. The second end may be moved into the compressed state when the first projection passes through the second member and may be moved into the expanded state after passing through the second member. The second end may be biased into the expanded state. Additionally or alternatively, the second member may be disposed between the first end of the first projection and the second end of the first projection in the attached state. The cross-section of the second end of the first projection may be at least one of a different size and shape than the first end of the first projection.

In one configuration, the first member is disposed on an opposite side of the flexible material than the second member when the second member is in the attached state. The second member may include a second retention feature that has an opening and at least one tab that extends into the opening. The opening may receive a portion of the first member therein when the second member is in the attached state. The flexible material may be disposed between the portion of the first member and the at least one tab when the second member is in the attached state. The first member may have an opening that extends between the first surface and the second surface. The opening may be operable to expose a portion of the device when the device is disposed within the void.

In another configuration, an attachment apparatus for selectively attaching a device, such as a smartphone or a portable audio player, for example, to a flexible material, is provided and may include a first member, a second member, and a void. The first member may have a first wall that includes a first surface and a second surface formed on an opposite side of the first wall than the first surface. The second member may be selectively attached to the first member in an attached state to connect the second member to the first member and to the flexible material. In addition, the second member may be disposed on an opposite side of the flexible material than the first member when the second member is in the attached state. The void may be formed between the second surface of the first wall and the flexible material when the second member is in the attached state and may be operable to receive the device therein. The first member may be operable to support the device within the void between the second surface of the first member and the flexible material when the second member is in the attached state. The first member may position a portion of the flexible material within the second member when the second member is in the attached state to attach the first member and the second member to the flexible material.

The first member may include at least one positioning feature operable to position the device relative to the first member when the second member is in the attached state. The at least one positioning feature may include a tab extending from the second surface of the first member and operable to engage the device to urge the device toward the flexible material. The first member may include a first projection extending from the second surface. The first projection may include a first end attached to the first member and a second end disposed at a distal end of the first projection. The second end may have a different cross-section than the first end and may define a first retention feature.

In one configuration, the second end is movable between a compressed state and an expanded state. The second end may be moved into the compressed state when the first projection passes through the second member and may be moved into the expanded state after passing through the second member. The second end may be biased into the expanded state. The second member may be disposed between the first end of the first projection and the second end of the first projection in the attached state. The cross-section of the second end of the first projection may include at least one of a different size and shape than the first end of the first projection.

The second member may include a second retention feature that has an opening and at least one tab that extends into the opening. The opening may receive a portion of the first member therein when the second member is in the attached state. The flexible material may be disposed between the portion of the first member and the at least one tab when the second member is in the attached state. The first member may include an opening that extends between the first surface and the second surface. The opening may be operable to expose a portion of the device when the device is disposed within the void.

In yet another configuration, an attachment apparatus for selectively attaching a device, such as a smartphone or a portable audio player, for example, to a flexible material, is provided and may include a first member, a second member, and a void. The first member may have a first wall that includes a first surface and a second surface formed on an opposite side of the first wall than the first surface. The second member may be selectively attached to the first member in an attached state to connect the second member to the first member and to the flexible material. The flexible material may be disposed between the second member and the first member when the second member is in the attached state. The void may be formed between the second surface of the first wall and the flexible material when the second member is in the attached state and may be operable to receive the device therein. The first member may be operable to support the device within the void between the second surface of the first member and the flexible material when the second member is in the attached state.

The first member may be disposed on an opposite side of the flexible material than the second member when the second member is in the attached state. The first member may include at least one positioning feature operable to position the device relative to the first member when the second member is in the attached state. The at least one positioning feature may include a tab that extends from the second surface of the first member and may be operable to engage the device to urge the device toward the flexible material. The first member may include a first projection extending from the second surface. The first projection may also include a first end attached to the first member and a second end disposed at a distal end of the first projection. The second end may have a different cross-section than the first end and may define a first retention feature.

In one configuration, the second end is movable between a compressed state and an expanded state. The second end may be moved into the compressed state when the first projection passes through the second member and may be moved into the expanded state after passing through the second member. The second end may be biased into the expanded state. The second member may be disposed between the first end of the first projection and the second end of the first projection in the attached state.

The cross-section of the second end of the first projection may include at least one of a different size and shape than the first end of the first projection. The second member may include a second retention feature that has an opening and at least one tab extending into the opening. The opening may receive a portion of the first member therein when the second member is in the attached state. The flexible material may be disposed between the portion of the first member and the at least one tab when the second member is in the attached state. The first member may include an opening that extends between the first surface and the second surface, where the opening is operable to expose a portion of the device when the device is disposed within the void.

FIG. 1 illustrates a user 2 wearing a shirt formed from a flexible material 4. A device 6, such as a smartphone or a portable audio player, for example, is attached to the flexible material 4 by way of an attachment apparatus 10. As shown, the user 2 may attach or secure his/her device 6 anywhere on the flexible material 4, such as, but not limited to, a sleeve or a body portion of the shirt 4. The attachment apparatus 10 securely attaches to the flexible material 4, allowing the user 2 to be mobile and active without worrying about the security of his/her smartphone or portable audio player 6. As such, the user 2 may attach the attachment apparatus 10 on an inside of the flexible material 4 to face his/her body or on an outside of the flexible material 4 to face outwardly in an opposite direction from his/her body. As described below, the attachment apparatus 10 has a rectangular shape, however, the attachment apparatus 10 may be any other shape, such as, but not limited to, a square shape, a circular shape, or any other shape configured to receive a device 6.

With reference to FIGS. 2-14, the attachment apparatus 10 includes a first member 12 and a second member 14 that cooperate to define a void 16 when the attachment apparatus 10 is attached to a flexible substrate such as, for example, the flexible material 4 of the shirt of FIG. 1. The attachment apparatus 10 may be used to selectively attach the device 6 to the flexible material 4. In some examples, the flexible material 4 is an article of clothing, such as, but not limited to, a jacket, a sweater, a t-shirt, or pants. The flexible material 4 may be textile or cloth having a network of natural and/or artificial fibers. The attachment apparatus 10 may be used with multiple types of flexible material 4 having varying degrees of thickness.

The first member 12 includes a first wall 18 and a second wall 20. The first wall 18 defines a first opening 22 that allows a user 2 to view a display of the attached device 6. As shown, the first opening 22 has a rectangular shape; however, other shapes are possible as well. For example, the opening 22 may have a rectangular shape, a square shape, a circular shape, or any other shape allowing a user 2 to view the display of an attached device 6. In some examples, the attachment apparatus 10 is specifically designed to receive a specific device model. As such, the opening 22 may be designed to complement the shape of the display of the specific device.

In some examples, the first wall 18 includes a first surface 24 and a second surface 26 formed on an opposite side of the first wall 18 than the first surface 24. During use, the first surface 24 faces in an outward direction and the second surface 26 faces in an inward direction, toward the flexible material 4. As such, the second surface 26 opposes and may be in contact with the device 6 during use. In some examples, the first opening 22 extends between the first surface 24 and the second surface 26 of the first wall 18.

The second wall 20 extends from the second surface 26 of the first wall 18 and includes a first surface 28, a second surface 30, and an engagement surface 32. The second wall 20 extends from an edge of the second surface 26 and cooperates with the second surface 26 to define, in part, the void 16. The first surface 28 of the second wall 20 is formed on an opposite side of the second wall 20 than the second surface 30 and cooperates with the first wall 18 to define an overall internal shape of the first member 12. In one configuration, the second surface 30 of the second wall 20 and the second surface 26 of the first wall 18 are connected to one another to define an inner shape of the first member 12 and, thus, a shape of the void 16. Similarly, the first surface 24 of the second wall 20 and the first surface 28 of the first wall 18 are connected to one another to define an outer surface and overall outer shape of the first member 12.

In some examples, the first wall 18 is positioned at a perpendicular angle with respect to the second wall 20. In other examples, the first wall 18 and the second wall 20 form an angle with respect to one another that is greater or less than ninety degrees (90°). The first wall 18 and the second wall 20 may be connected to one another at a junction 19 of the first wall 18 and the second wall 20, whereby the junction 19 includes an arcuate shape. The arcuate shape of the junction 19 provides a smooth transition between the first wall 18 and the second wall 20 and, as such, provides the first member 12 with a generally smooth outer surface. In so doing, the outer surface of the first member 12 is free from sharp edges that may be uncomfortable to a user when the attachment apparatus 10 is attached to the flexible material 4 of an article of clothing, for example.

The engagement surface 32 of the second wall 20 extends between and connects the first surface 28 and the second surface 30 at a distal end of the second wall 20 that is located on an opposite end of the second wall 20 from the junction 19. The engagement surface 32 may define a plane that is substantially parallel with a plane formed by the second surface 26 of the first wall 18 or, alternatively, may be formed at an angle with respect to the plane defined by the second surface 26 of the first wall 18. If the engagement surface 32 is formed at an angle relative to the plane defined by the second surface 26, the engagement surface 32 may be positioned such that the engagement surface 32 slopes toward or away from the first opening 22 around the entire perimeter of the second wall 20. While the engagement surface 32 is described as defining a plane, the engagement surface 32 could alternatively include a convex or rounded shape. Providing the engagement surface 32 with a convex or rounded shape provides the engagement surface 32 with a generally smooth surface that abuts the flexible material 4 and, thus, reduces the likelihood that the second wall 20 will snag the flexible material 4 during use.

The second wall 20 may include one or more openings or apertures 34 that allow one or more wires associated with the device 6 to pass through the second wall 20 and into the void 16. Each opening 34 is sized to allow at least one wire of the device 6 to pass through the second wall 20 and into the void 16. For example, if the device 6 is a smartphone or a portable audio player that receives earphones at an audio jack of the device 6 by way of a ¼ inch (6.35 millimeters) or ⅛ inch (3.5 millimeters) phone jack, the opening 34 allows the phone jack of the earphones to reach the audio jack of the portable audio player (i.e., device 6). The opening 34 may have a U-shape, a semi-circular shape, or any other shape sized to receive a wire extending from the device 6 to the user 2.

In some examples, the first member 12 includes a retention feature such as one or more projections 36 that are disposed on and extend from the engagement surface 32 of the second wall 20. The projections 36 may include a first end 38 and a second end 40. The first end 38 of the projections 36 is attached to the engagement surface 32 and the second end 40 is disposed at a distal end of each projection 36. The first end 38 has a first cross-section and the second end 40 has a second cross-section, where the first and second cross-sections are different. For example, the second end 40 may include at least one of a different shape and/or size than the first end 38. The first end 38 and the second end 40 may each have substantially circular cross-sectional shapes, whereby the first end 38 includes a diameter that is smaller than a diameter of the second end 40. In some examples, as shown in FIGS. 9, 10, 13 and 14, the projections 36 include a material 37 disposed on a surface of the distal end 40 of each projection 36 that is different than the material forming the projection 36. For example, the material 37 may be formed from a material that is softer and/or more flexible than the material forming the projection 36 in an effort to increase the comfort of a user 2 during use. In one configuration, the material 37 may include at least one of rubber and foam that act as a barrier between the material of the projection 36 and a user 2 to prevent the projections 36 from irritating the user's skin during use.

While the projections 36 are described and shown as being substantially circular, the projections 36 could include other shapes that mate with and are received by the second member 14. Further, the projections 36 could have a different shape at the first end 38 than at the second end 40. For example, the cross-sectional shape of the first end 38 could define a square, while the cross-sectional shape of the second end 40 defines a circle. Other shape combinations for the first and second ends 38, 40 may be used.

Figure 3:
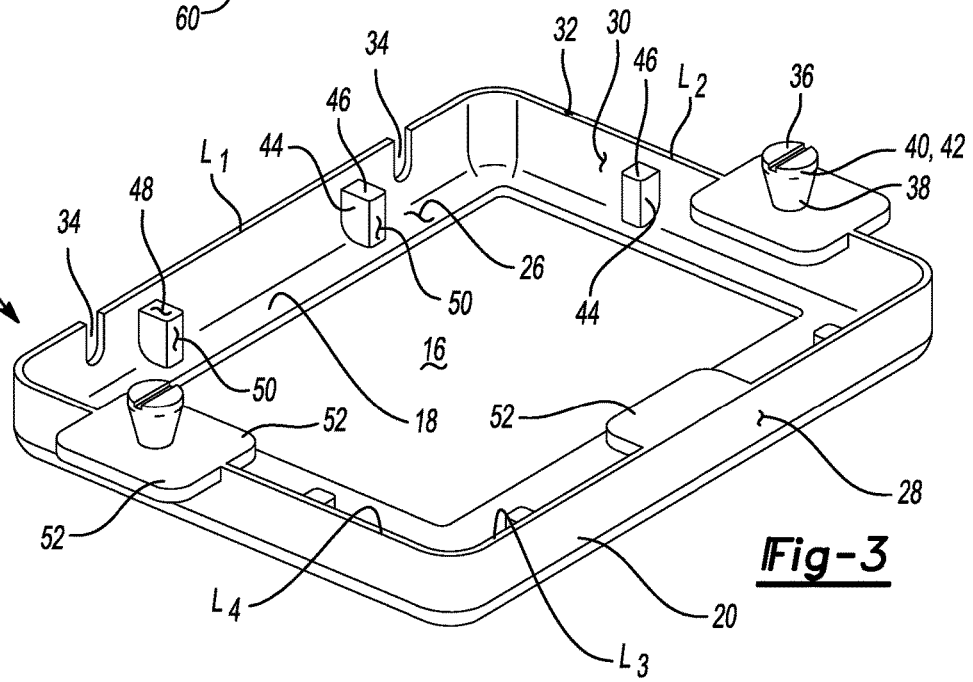
FIG. 3 is a rear perspective view of a first member of the attachment device of FIG. 1.

As shown in FIG. 3, the first member 12 may include more than one projection 36 extending from the engagement surface 32. Further, the projections 36 may include the same shape or, alternatively, could include different shapes. Regardless of the particular shape of the projections 36, the projections 36 extend from the engagement surface 32 on opposing sides of the second wall 20.

If the first member 12 includes more than two projections 36, each length ($L_1$-$L_4$) of the second wall 20 may include a projection 36. Alternatively, if the first member 12 includes three projections 36, one length ($L_1$) of the second wall 20 may include a single projection 36 with the opposing length ($L_3$) of the second wall including a pair of projections 36 such that the three projections 36 cooperate to form the vertices of a triangle.

The projections 36 may be moved from a relaxed or expanded state to a compressed state and may be biased into the relaxed state by the material of the projections 36. For example, the projections 36 may be formed integrally with the first member 12 and may be formed from a resilient material such as plastic. The plastic material of the first member 12 and, thus, the projections 36, may cause the projections 36 to automatically return to the relaxed state from the compressed state when a compressive force applied to the projections 36 is released.

As shown in FIG. 3, the projections 36 may additionally include a slit 42 formed in the distal end 40 that allows the projections 36 to more easily be deformed and moved from the relaxed state to the compressed state. The slit 42 allows the material of each projection 36 to move toward one another and into the slit 42 when a compressive force of a predetermined magnitude is applied to the particular projection 36.

In some examples, the first member 12 includes a positioning feature 44 that engages and positions the device 6 relative to the first opening 22 and, thus, relative to the first member 12. The positioning feature 44 may be integrally formed with and extend from the first wall 18 of the first member 12 towards the engagement surface 32 of the second wall 20. In some examples, a distal end 46 of the positioning feature 44 includes an engagement surface 48 that engages the device 6 to position the device 6 relative to the opening 22 during use. The distal end 46 and, thus, the engagement surface 48 may be recessed from the engagement surface 32 to provide a clearance for receiving a portion of the device 6. While the distal end 46 is described and shown as including an engagement surface 48, the positioning feature 44 could additionally or alternatively include a vertical engagement surface 50 (FIG. 3) formed on a surface that is substantially perpendicular to the engagement surface 48 that engages the same or different sized device 6.

As described above, the positioning features 44 may be integrally formed with the first member 12. As such, the positioning features 44 may be integrally formed and attached to both of the first wall 18 and the second wall 20. The positioning features 44 therefore effectively increase the thickness of the walls 18, 20 at the location of each feature 44. Accordingly, the positioning features 44 not only serve to position a device 6 relative to and within the first member 12 but also provide the walls 18, 20 with increased strength and support. The increase in strength and support provides reinforcement to the walls 18, 20 and, thus, helps maintain the relative position of the first wall 18 and the second wall 20 when a force is applied to one or both walls 18, 20. As such, the increase in thickness of the walls 18, 20 at each positioning feature 44 provides a degree of protection to the attachment apparatus 10 and to the device 6 contained therein. The projections 44 may include a square or rectangular shape as shown or, alternatively, may include a circular shape.

In some examples, the first member 12 includes a grip 52 that extends from one or both of the first surface 28 and the second surface 30 of the second wall 20. The grip 52 may be substantially flush with the engagement surface 32 such that the engagement surface 32 extends onto and flush with the grip 52.

Figure 5:
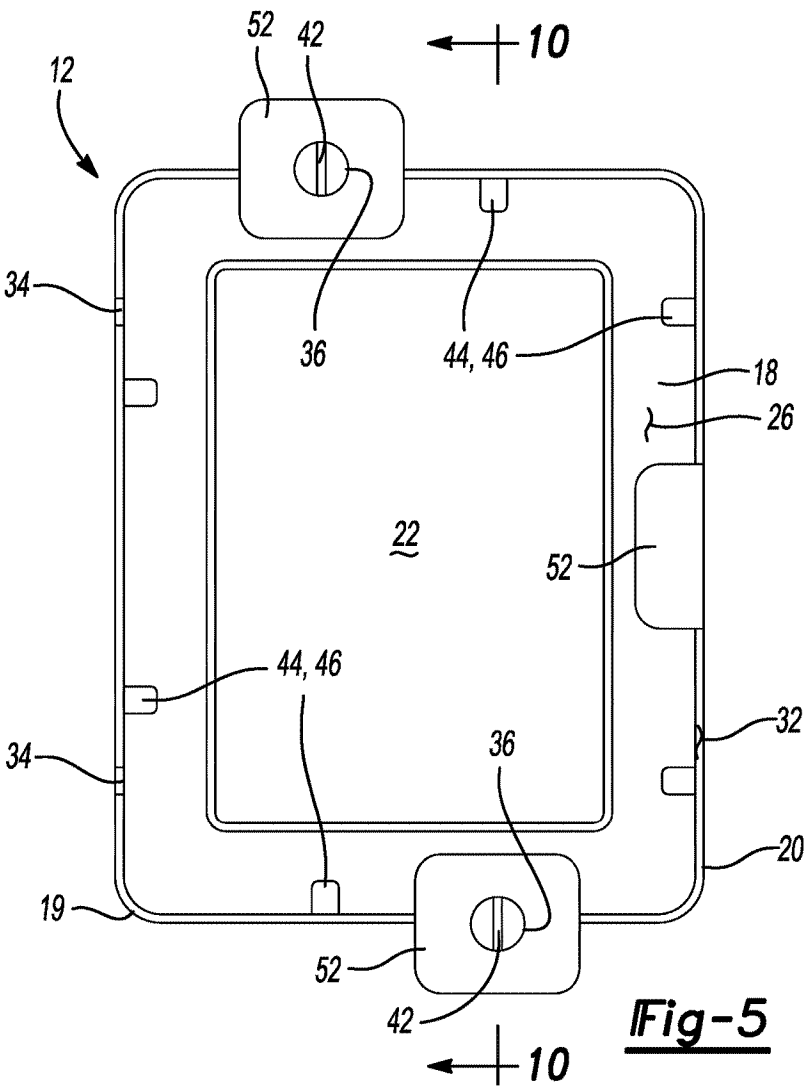
FIG. 5 is a rear view of the first member of attachment device of FIG. 1.
Figure 4:
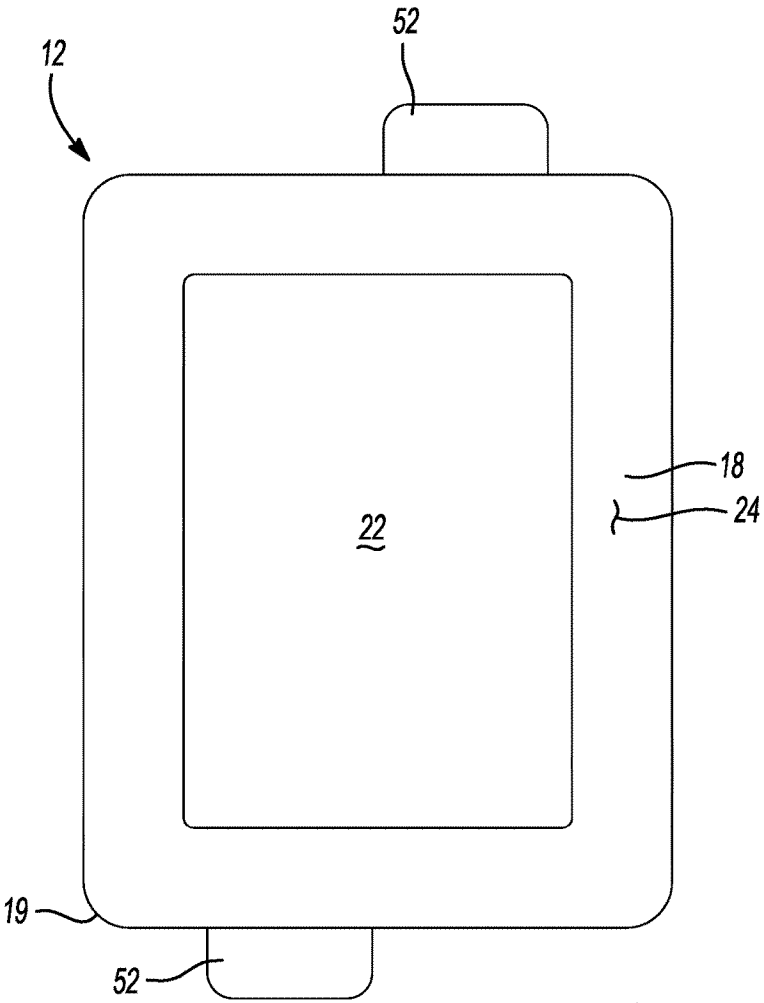
FIG. 4 is a front view of the first member of the attachment device of FIG. 1.
Figure 7:
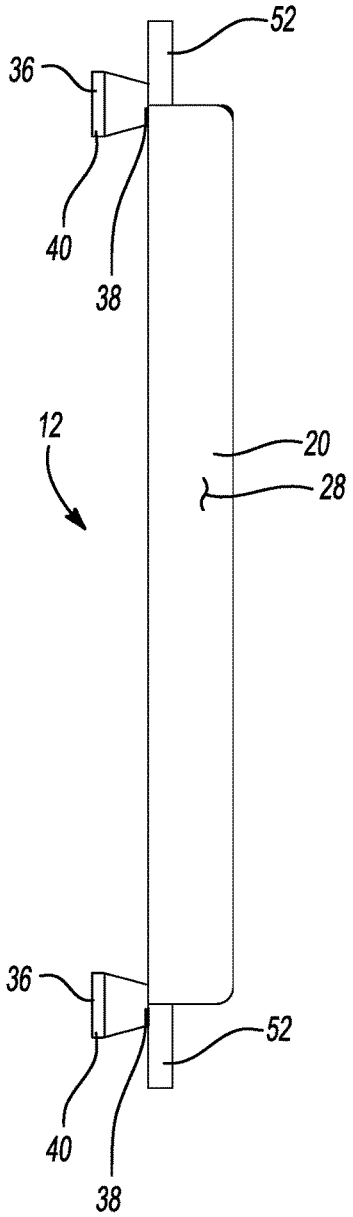
FIG. 7 is a side view of the first member of attachment device of FIG. 1.
Figure 6:
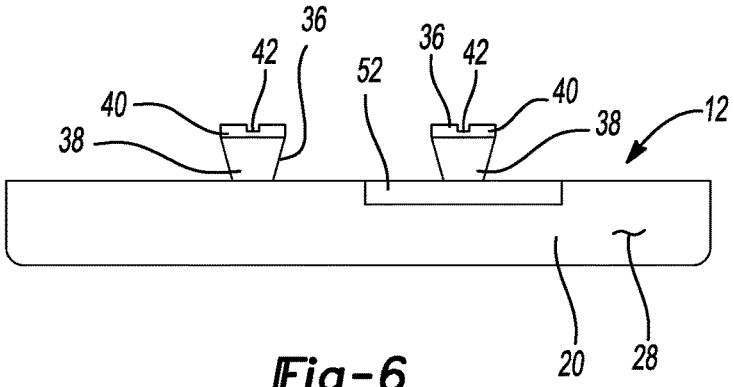
FIG. 6 is a side view of the first member of attachment device of FIG. 1.
Figure 8:
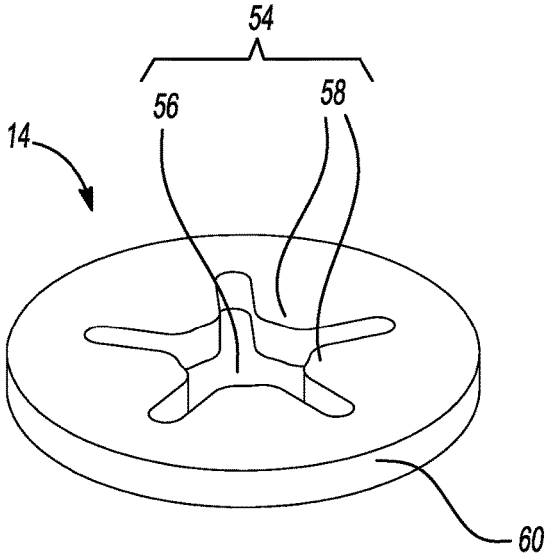
FIG. 8 is a perspective view of a second member for use with the first member of FIG. 1.
Figure 10:
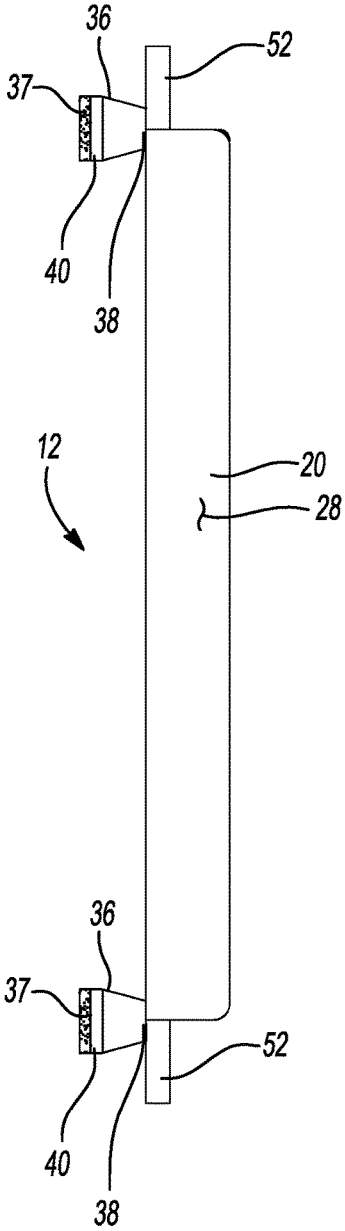
FIG. 10 is a side view of the first member of the attachment device of FIG. 1.
Figure 9:
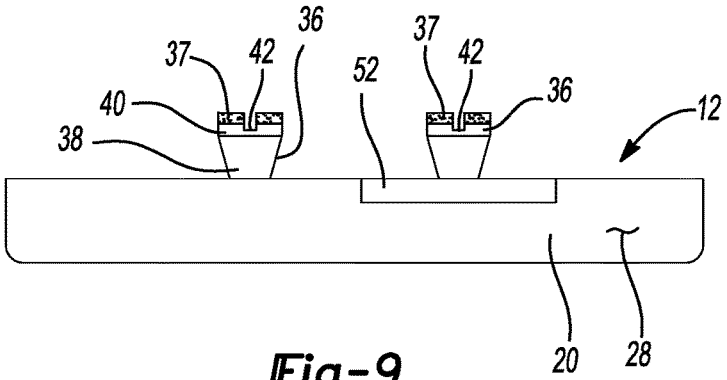
FIG. 9 is a side view of the first member of the attachment device of FIG. 1.
Figure 15:
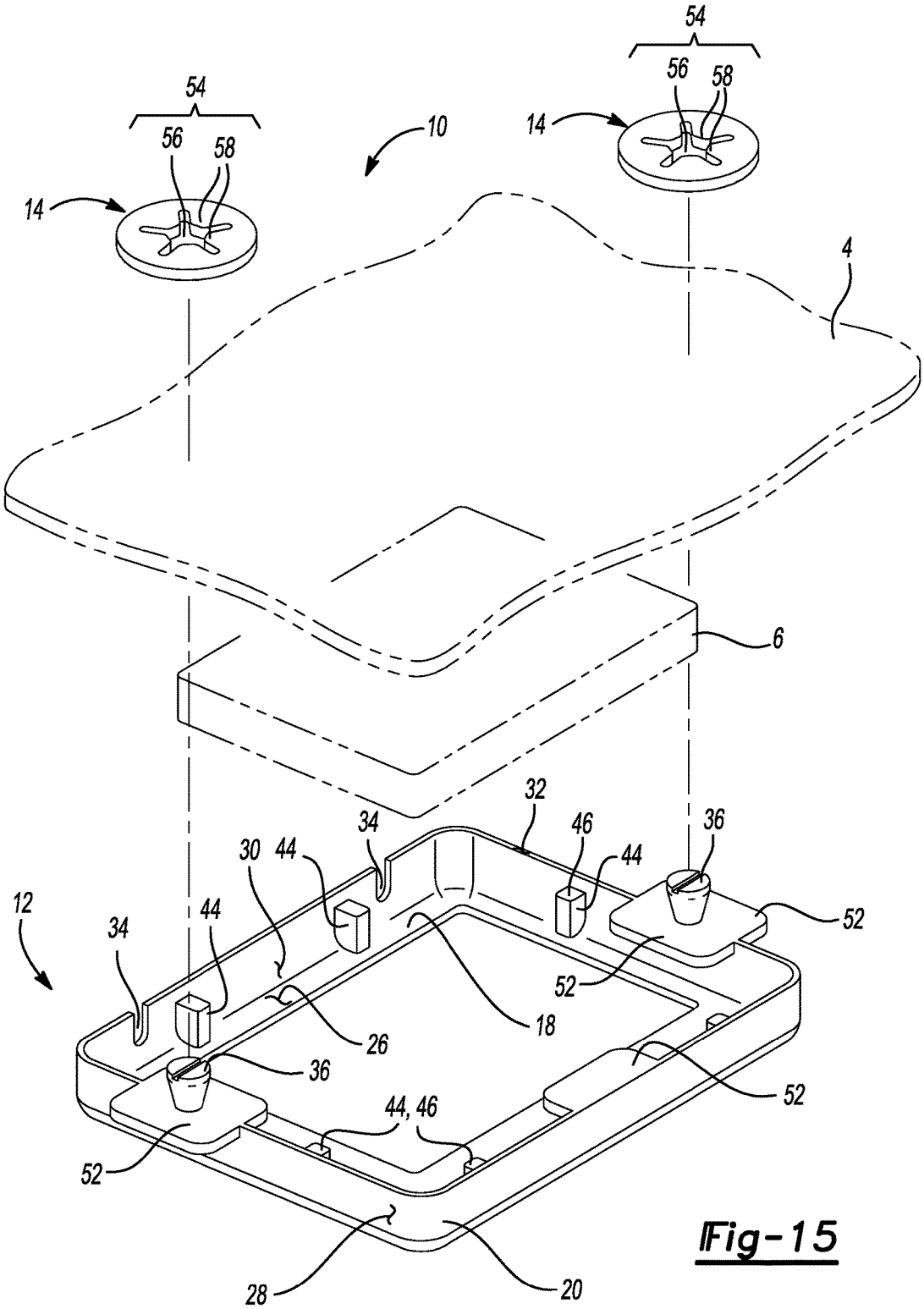
FIG. 15 is an exploded view of the attachment device of FIG. 1.
Figure 16:
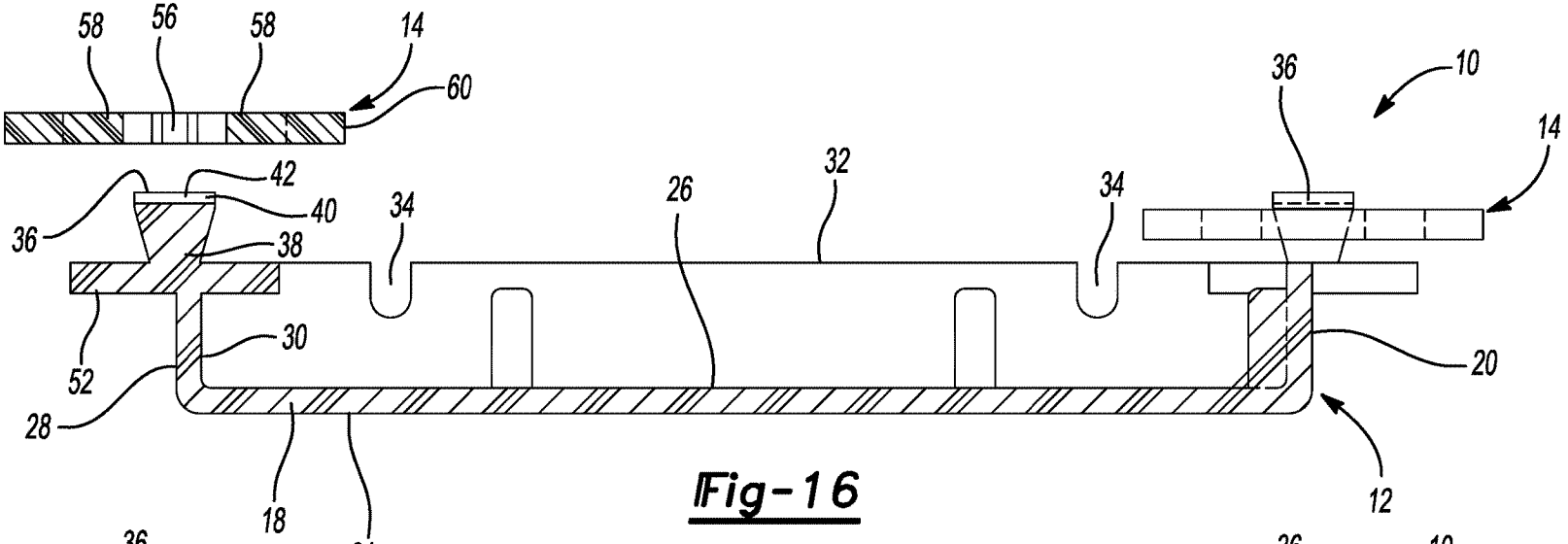
FIG. 16 is a cross-sectional view taken through an attachment feature of the attachment device of FIG. 1.
Figure 17:
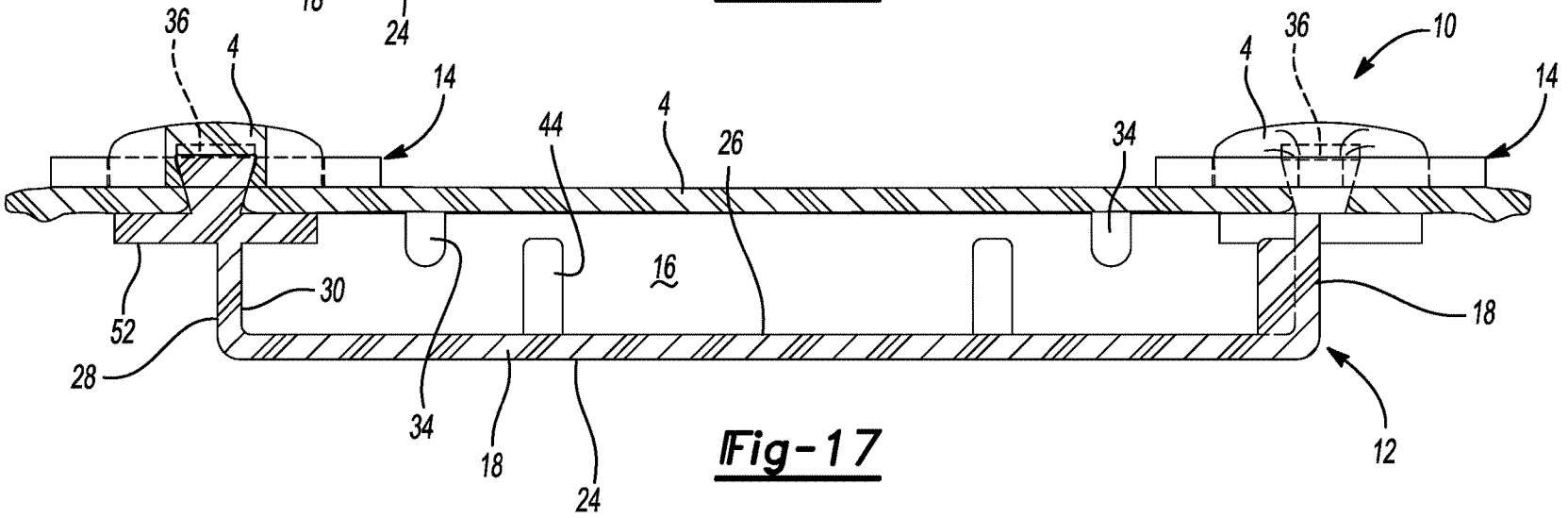
FIG. 17 is a cross-sectional view taken through an attachment feature of the attachment device of FIG. 1 shown attached to an article of clothing.
Figure 18:
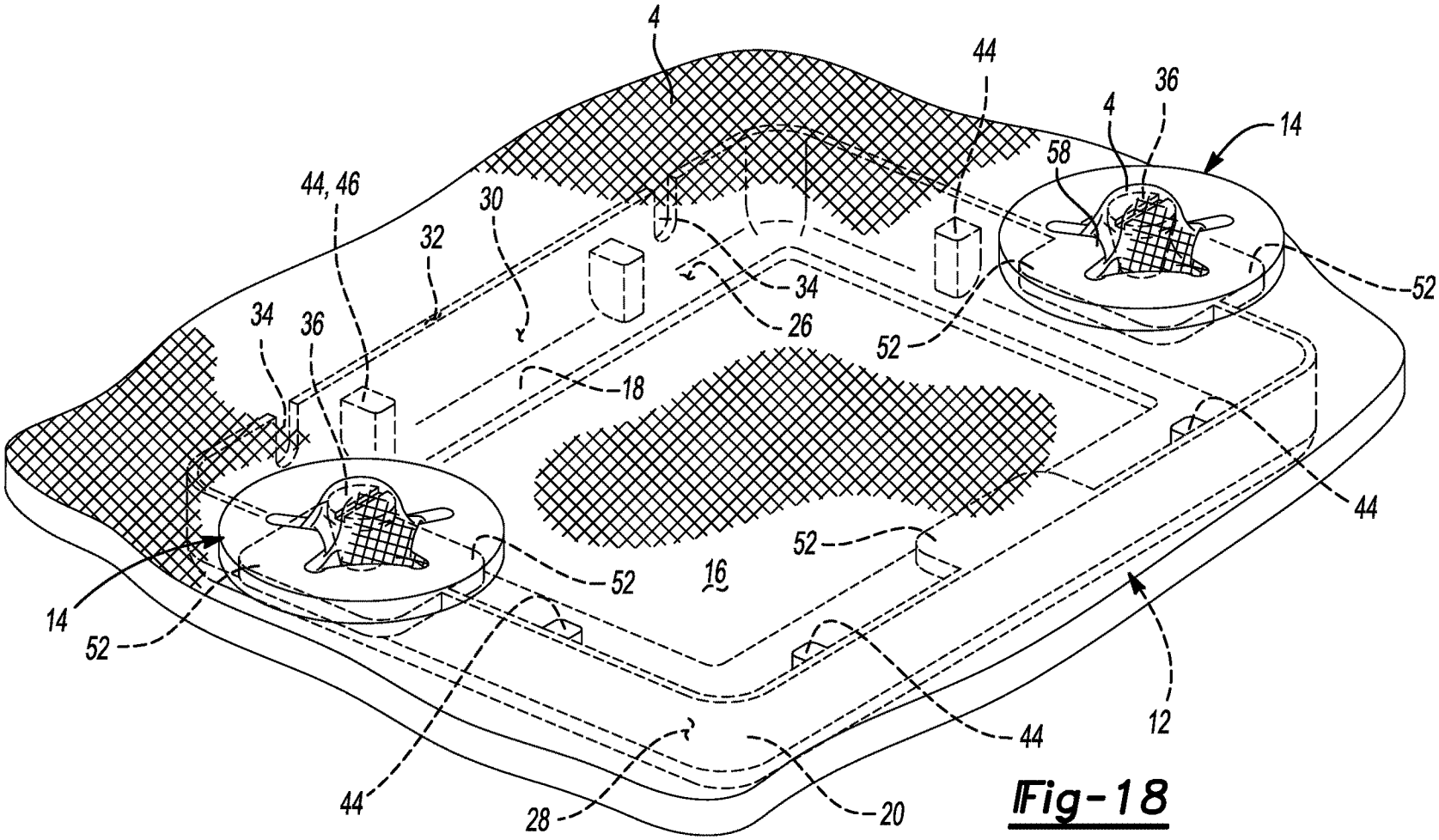
FIG. 18 is a perspective view of the attachment device of FIG. 1 attached to an article of clothing.
Figure 19:
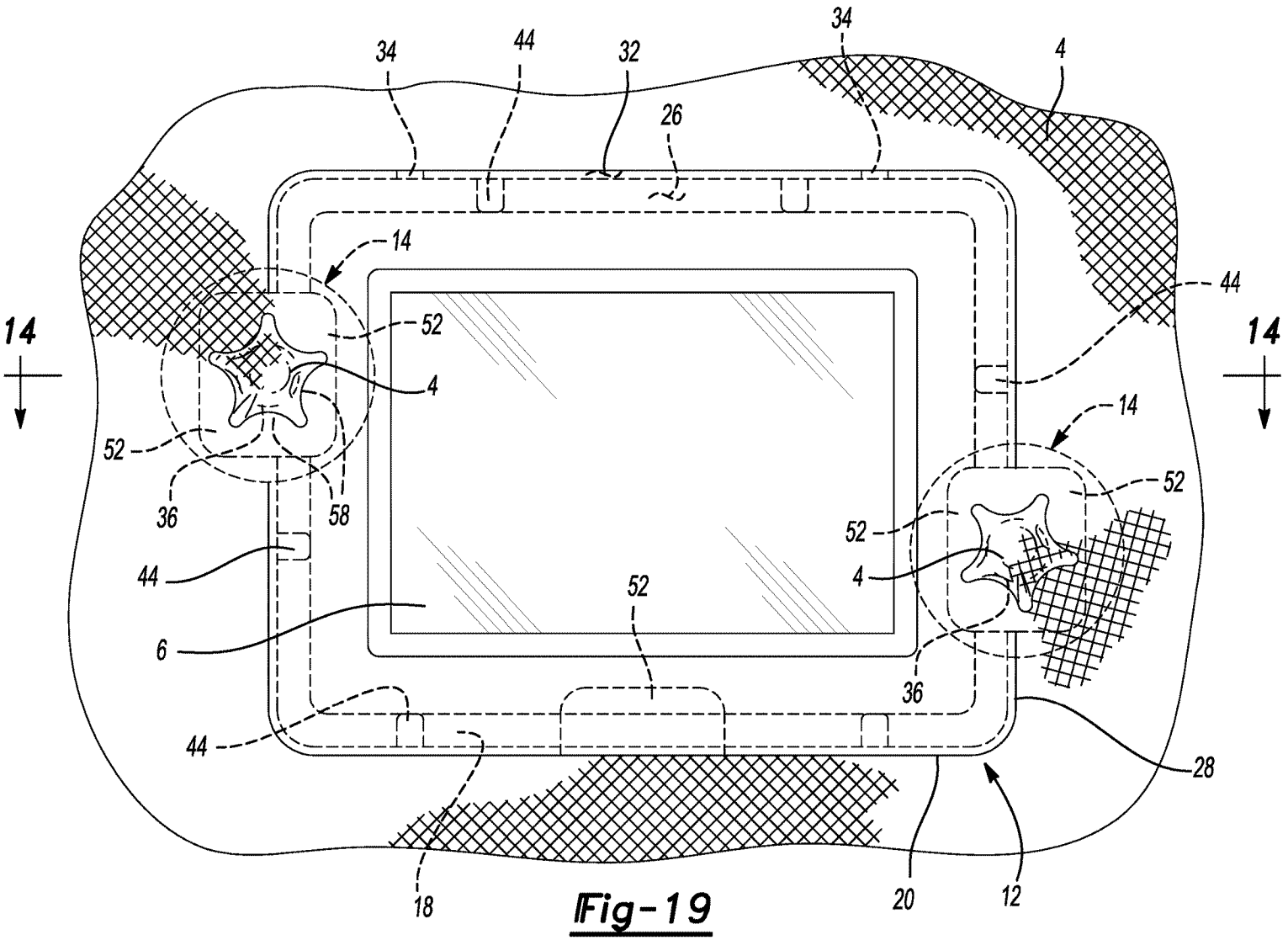
FIG. 19 is a perspective view of the attachment device of FIG. 1 attached to an article of clothing and supporting an external device relative to the article of clothing.
Figure 20:
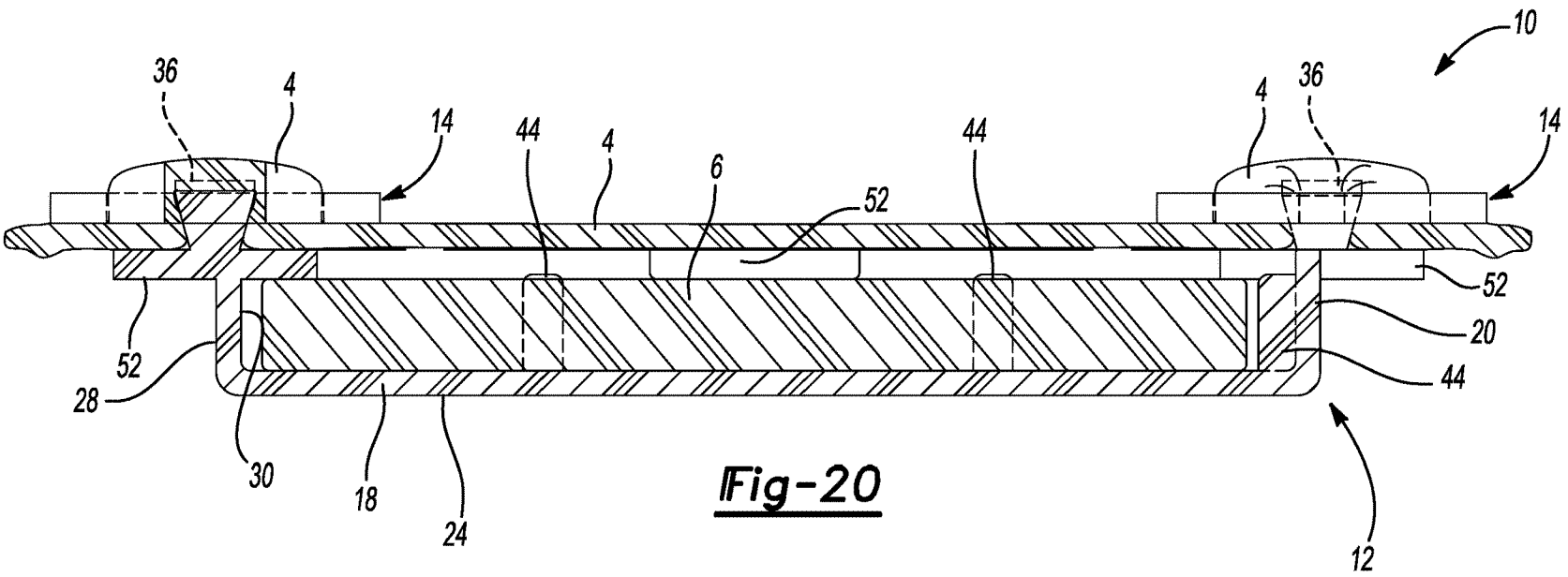
FIG. 20 is a cross-sectional view of the attachment device shown in FIG. 19 showing the external device supported relative to the article of clothing.

As shown in FIGS. 3, 5, and 15, a grip 52 may be located at a base of each projection 36. Locating a grip 52 at the base of each projection 36 (i.e., at the first end 38) allows the projections 36 to include a first end 38 having a larger diameter than a width of the second wall 20 at the engagement surface 32 without causing a portion of the first end 38 to be exposed. Further, providing the grips 52 at the locations of the projections 36 also strengthens the second wall 20 at the projections 36 by increasing the surface area contact between the projections 36 and the second wall 20. Specifically, the surface area contact of the projections 36 and the second wall 20 increases from a linear distance equal to the diameter of the first end 38 (i.e., if the projections 36 were directly connected to the second wall 20 separate from the grips 52) to the linear distance of the grips 52 (i.e., the linear distance that the grips 52 are in contact with the second wall 20). Finally, the grips 52 may be integrally formed with one or both of the second wall 20 and the projections 36 and, further, may extend away from one or both of surfaces 28, 30. Extending the grips 52 away from the first surface 28 allows the grips 52 to engage and retain the device 6 within the first member 12 and extending the grips 52 from the second surface 30 allows the grips 52 to provide a surface against which a user 2 can easily grasp the first member 12 to attach or remove the first member from engagement with the second member 14.

Figure 11:
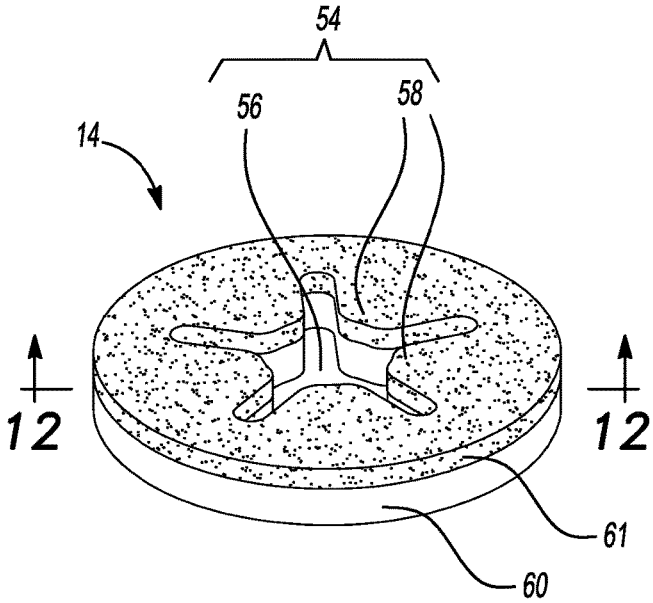
FIG. 11 is a perspective view of the second member for use with the first member of the of FIG. 1.
Figure 12:
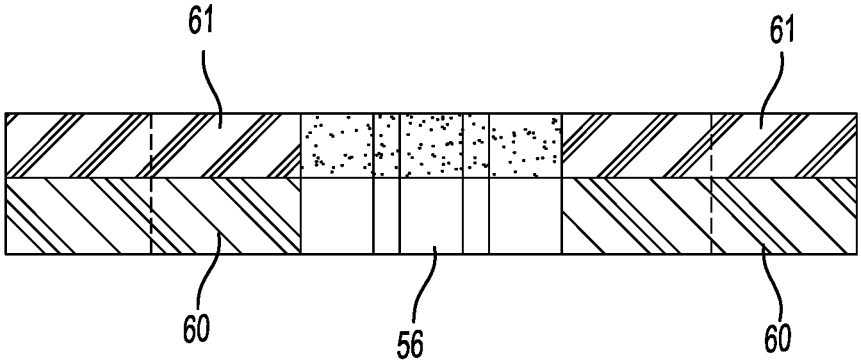
FIG. 12 is a cross-sectional view of the second member of FIG. 11 taken along Line 12-12 of FIG. 11.
Figure 13:
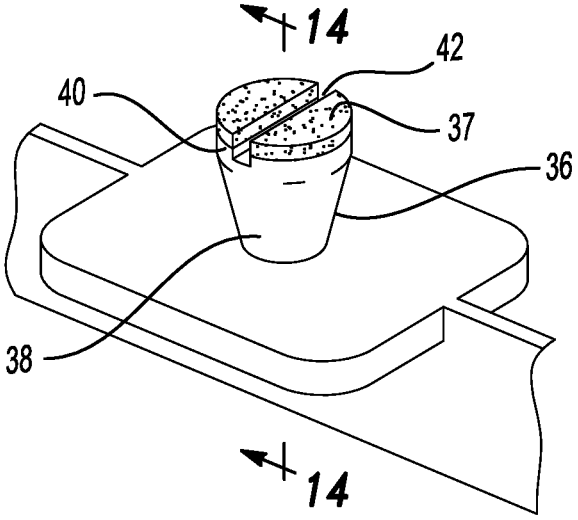
FIG. 13 is a perspective view of the first member of FIG. 9.
Figure 14:
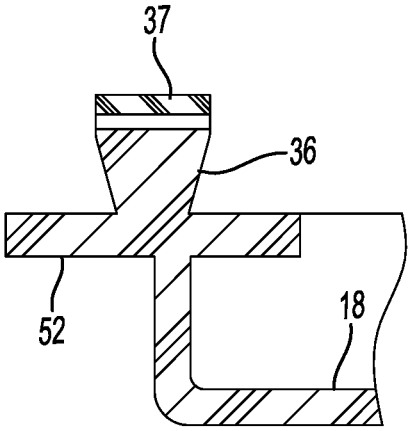
FIG. 14 is a partial cross-sectional view of first member of FIG. 13 taken along Line 14-14 of FIG. 13.

The second member 14 includes a second retention feature 54 that defines a second opening 56 and at least one tab 58 extending into the second opening 56. The second member 14 may be manufactured from the same or different material than the material used to manufacture the first member 12. In addition, the second member 14 may be manufactured from one or more materials. Each tab 58 of the second retention feature 54 extends from an outer periphery 60 of the second member 14 towards the second opening 56. In some examples, each tab 58 includes soft corners to prevent wear of the flexible material 4 during use. As set forth below and during use of the attachment apparatus 10, the second opening 56 receives the projection 36 of the first member 12 and the flexible material 4 therein in an attached state. In some configurations, the second member 14 includes multiple second retention features 54, whereby each second retention feature 54 defines a second opening 56 having a different opening size and/or a different overall diameter that is sized to accommodate flexible materials 4 having different thicknesses and/or stretch. For example, a second member 14 having a larger second opening 56 can accommodate a thicker flexible material 4 as compared to a second member 14 having a smaller second opening 56. In addition, in some configurations, as shown in FIGS. 11 and 12, the second member 14 includes a layer of soft material 61 disposed on one end of the second member 14 that is opposite to the end configured to receive the flexible material 4. As such, during use of the attachment apparatus 10, the soft material 61 of the second member 14 is facing outwardly opposite the first member 12. In the attached state, when the second opening 56 of the second member 14 receives the projection 36, the soft material 61 of the second member 14 may be substantially flush with the received projection 36. The second retention features 54 are designed for attachment to a flexible material 4 having a particular thickness but may be used in conjunction with the same first member 12. Namely, provided the second opening 56 of each second member 14 is smaller than the diameter of the second end 40 of the projections 36 when the projections 36 are in the relaxed state, the second members 14 may all be used with the same first member 12 and can be interchanged depending on the particular material of the flexible material 4. As such, the particular material of the flexible material 4 determines which of a number of available second members 14 should be used to properly secure the first member and device 6 relative to the flexible member 4.

The available second members 14 may be temporarily or permanently connected to one another by way of a connector 62. In some configurations, the user 2 may snap the connectors 62 to separate the multiple second members 14. In other examples, the second members 14 may remain connected, which allows the user 2 to easily alternate between different second members 14 to select one that properly fits a particular flexible material 4.

The void 16 may be bounded by the second surface 26 of the first wall 18, the second surface 30 of the second wall 20, and the one or more grips 52. In an attached state, the void 16 may be bound by the second surface 26 of the first wall 18, the second surface 30 of the second wall 20, the one or more grips 52, and the flexible material 4. The void 16 releasably receives the device 6, while the first member 12 supports the device 6 within the void 16, for example, using the positioning feature 44 and/or the grips 52. In one configuration, the void 16 has a depth that is substantially equal to a height of the second wall 20 of the first member 12, where the height of the second wall 20 is measured from the second surface 26 of the first member 12.

Referring to FIGS. 15-20, operation of the attachment apparatus 10 will be described in detail. In the attached state, the second member 14 is selectively attached to the first member 12 with a portion of a flexible material 4 disposed therebetween in an effort to attach the attachment apparatus 10 to the flexible material 4. Specifically, the second retention feature 54 of the second member 14 is selectively attached to the projections 36 of the first member 12 in the attached state, thereby allowing the first member 12 to be connected to the second member 14 and to the flexible material 4. When in the attached state, the flexible material 4 is disposed between the first member 12 and the second member 14 and, further, the second member 14 is disposed along a length of the respective projections 36.

A user may first position a device 6 within the first member 12 before attaching the first member 12 to either one of the second member 14 and the flexible material 4. Namely, the device 6 may be located within the first member 12 and may engage the engagement surfaces 48 of the positioning features 44. The positioning features 44 properly position the device 6 relative to the first member 12 and, thus, to the opening 22. Positioning the device 6 relative to the opening 22 allows a user to view and/or manipulate the device 6 through the opening during use.

Once the device 6 is properly located within the first member 12, the first member 12 may be attached to the second member 14. Namely, the first member 12 may be positioned on one side of the flexible material 4 and the second member 14 may be positioned on an opposite side of the flexible material 4 than the first member 12. Once positioned on opposite sides of the flexible material 4, the second members 14 may be aligned with respect ones of the projections 36 to allow the projections 36 to engage and be received by the second retention features 54.

The projections 36 may be received by the respective openings 56 of the retention features 54 and cause a portion of the flexible material 4 to extend into the second members 14 at the openings 56 such that the flexible material 4 is located between the projections 36 and the tabs 58. When the projections 36 pass through respective openings 56 of the second members 14, the tabs 58 deflect and apply a compressive force on the second end 40 of the projections 36, thereby moving the projections 36 from the relaxed state to the compressed state. Movement of the projections 36 into the compressed state is facilitated by the slits 42 formed in the second end 40, as described above.

Once the projections 36 pass through the second member 14 such that the first end 38 of each projection 36 is disposed on an opposite side of a respective second member 14 than the second end 40, the projections 36 return to the expanded state. Return to the expanded state is accomplished by the resilient nature of the material forming the projections 36 and serves to increase the effective diameter of the second end 40. In so doing, the projections 36 have a second end 40 with a diameter that is larger than the openings 56 of the second member 14. Accordingly, the projections 36 are restricted from being removed from the second member 14 and, as a result, maintain the first member 12 and the device 6 in contact with the flexible material 4.

While in the attached state, the first member 12 is disposed on an opposite side of the flexible material 4 than the second member 14. As such, the flexible material 4 is disposed between the projection 36 and the at least one tab 58 when the second member 14 is in the attached state. In other words, the first member 12 positions a portion of the flexible material 4 within the second member 14 when the second member 14 is in the attached state, thereby attaching the first member 12 and the second member 14 to the flexible material 4 by compressing (i.e., pinching) a portion of the flexible material between an outer surface of each projection 36 and the tabs 58. While in the attached state, the first opening 22 defined by the first wall 18 of the first member 12 exposes a portion of the device 6 (i.e., a display) when the device 6 is disposed within the void 16.

A force may be applied to the first member 12 to move the projections 36 and, thus, the flexible material 4, out of engagement with the second members 14. For example, a force may be applied to the first member 12 via one or more of the grips 52 to move the first member 12 away from the second members 14. Additionally or alternatively, a force may be applied to the second members 14 to move the second members 14 in a direction away from the first member 12. In so doing, the projections 36 are caused to traverse the respective openings 56 of the second members 14 and move from the relaxed state to the compressed state. Moving from the relaxed state to the compressed state reduces the effective diameter of the second end 40 of the projections 36, thereby allowing the projections 36 to pass through the openings 56. Once the projections 36 are sufficiently removed from the openings 56, the flexible material 4 may be separated from both the first member 12 and the second member 14 and the device 6 may be removed.

The attachment apparatus 10 includes the first member 12 having one or more projections 36, being the same size or having variable sizes. Each projection 36 has a complementary second member 14, where each second member 14 has multi-sized second retention features 54, allowing the attachment apparatus 10 to be used with different types of flexible materials 4 having varying thicknesses and textures. Therefore, the attachment apparatus 10, as described, provides a temporary but secure attachment without leaving permanent snap marks or punctures on the flexible material 4. The attachment apparatus 10 allows a user 2 to easily attach his/her personal mobile device 6 to the flexible material 4, resulting in ease of attachment and detachment of gadgets or personal mobile device 6.

The following Clauses provide an exemplary configuration for an attachment apparatus, as described above.

Clause 1: An attachment apparatus for selectively attaching a device to a flexible material, the attachment apparatus comprising a first member having a first wall defining a first opening and including a first surface and a second surface formed on an opposite side of the first wall than the first surface, the first member including a first projection extending in a direction away from the second surface and including a first retention feature, a second member having a second retention feature selectively attached to the first retention feature in an attached state to connect the second member to the first member and to the flexible material and a void formed between the second surface of the first wall and the flexible material when the second member is in the attached state and operable to receive the device therein, the first member operable to support the device within the void between the second surface of the first member and the flexible material when the second member is in the attached state.

Clause 2: The attachment apparatus of Clause 1, wherein the first projection is operable to extend a portion of the flexible material into the second member in the attached state.

Clause 3: The attachment apparatus of any of the preceding clauses, wherein the first member includes at least one positioning feature operable to position the device relative to the first opening when the second member is in the attached state.

Clause 4: The attachment apparatus of Clause 3, wherein the at least one positioning feature includes a tab extending from the second surface of the first member and operable to engage the device to urge the device toward the flexible material.

Clause 5: The attachment apparatus of any of the preceding clauses, wherein the first projection includes a first end attached to the first member and a second end disposed at a distal end of the first projection, the second end having a different cross-section than the first end and defining the first retention feature.

Clause 6: The attachment apparatus of Clause 5, wherein the second end is movable between a compressed state and an expanded state, the second end moved into the compressed state when the first projection passes through the second member and moved into the expanded state after passing through the second member.

Clause 7: The attachment apparatus of Clause 6, wherein the second end is biased into the expanded state.

Clause 8: The attachment apparatus of Clause 5, wherein the second member is disposed between the first end of the first projection and the second end of the first projection in the attached state.

Clause 9: The attachment apparatus of Clause 5, wherein the cross-section of the second end of the first projection includes at least one of a different size and shape than the first end of the first projection.

Clause 10: The attachment apparatus of any of the preceding clauses, wherein the first member is disposed on an opposite side of the flexible material than the second member when the second member is in the attached state.

Clause 11: The attachment apparatus of any of the preceding clauses, wherein the second retention feature includes a second opening and at least one tab extending into the second opening, the second opening receiving the first projection therein in the attached state.

Clause 12: The attachment apparatus of Clause 11, wherein the at least one tab engages the first retention feature in the attached state to maintain the second member in the attached state.

Clause 13: The attachment apparatus of Clause 11, wherein the flexible material is disposed between the first projection and the at least one tab when the second member is in the attached state.

Clause 14: The attachment apparatus of any of the preceding clauses, further comprising a second projection extending in a direction away from the second surface, the second projection operable to be attached to another second member in an attached state to secure the first member to the flexible material.

Clause 15: An attachment apparatus for selectively attaching a device to a flexible material, the attachment apparatus comprising a first member having a first wall including a first surface and a second surface formed on an opposite side of the first wall than the first surface and a second wall extending from the second surface and including an engagement surface, a second member selectively attached to the first member in an attached state to connect the second member to the first member and to the flexible material, and a void bounded by the second surface of the first wall, the second wall, and the flexible material when the second member is in the attached state and the engagement surface is in contact with the flexible material, the first member operable to support the device within the void when the second member is in the attached state.

Clause 16: The attachment apparatus of Clause 15, wherein the first member positions a portion of the flexible material within the second member when the second member is in the attached state to attach the first member and the second member to the flexible material.

Clause 17: The attachment apparatus of any of the preceding clauses, wherein the first member includes at least one positioning feature operable to position the device relative to the first member when the second member is in the attached state.

Clause 18: The attachment apparatus of Clause 17, wherein the at least one positioning feature includes a tab extending from the second surface of the first member and operable to engage the device to urge the device toward the flexible material.

Clause 19: The attachment apparatus of any of the preceding clauses, wherein the first member includes a first projection extending from the second surface, the first projection including a first end attached to the first member and a second end disposed at a distal end of the first projection, the second end having a different cross-section than the first end and defining a first retention feature.

Clause 20: The attachment apparatus of Clause 19, wherein the second end is movable between a compressed state and an expanded state, the second end moved into the compressed state when the first projection passes through the second member and moved into the expanded state after passing through the second member.

Clause 21: The attachment apparatus of Clause 20, wherein the second end is biased into the expanded state.

Clause 22: The attachment apparatus of Clause 19, wherein the second member is disposed between the first end of the first projection and the second end of the first projection in the attached state.

Clause 23: The attachment apparatus of Clause 19, wherein the cross-section of the second end of the first projection includes at least one of a different size and shape than the first end of the first projection.

Clause 24: The attachment apparatus of any of the preceding clauses, wherein the first member is disposed on an opposite side of the flexible material than the second member when the second member is in the attached state.

Clause 25: The attachment apparatus of any of the preceding clauses, wherein the second member includes a second retention feature having an opening and at least one tab extending into the opening, the opening receiving a portion of the first member therein when the second member is in the attached state.

Clause 26: The attachment apparatus of Clause 25, wherein the flexible material is disposed between the portion of the first member and the at least one tab when the second member is in the attached state.

Clause 27: The attachment apparatus of any of the preceding clauses, wherein the first member includes an opening extending between the first surface and the second surface, the opening operable to expose a portion of the device when the device is disposed within the void.

Clause 28: An attachment apparatus for selectively attaching a device to a flexible material, the attachment apparatus comprising a first member having a first wall including a first surface and a second surface formed on an opposite side of the first wall than the first surface, a second member selectively attached to the first member in an attached state to connect the second member to the first member and to the flexible material, the second member being disposed on an opposite side of the flexible material than the first member when the second member is in the attached state, and a void formed between the second surface of the first wall and the flexible material when the second member is in the attached state and operable to receive the device therein, the first member operable to support the device within the void between the second surface of the first member and the flexible material when the second member is in the attached state.

Clause 29: The attachment apparatus of Clause 28, wherein the first member positions a portion of the flexible material within the second member when the second member is in the attached state to attach the first member and the second member to the flexible material.

Clause 30: The attachment apparatus of any of the preceding clauses, wherein the first member includes at least one positioning feature operable to position the device relative to the first member when the second member is in the attached state.

Clause 31: The attachment apparatus of Clause 30, wherein the at least one positioning feature includes a tab extending from the second surface of the first member and operable to engage the device to urge the device toward the flexible material.

Clause 32: The attachment apparatus of any of the preceding clauses, wherein the first member includes a first projection extending from the second surface, the first projection including a first end attached to the first member and a second end disposed at a distal end of the first projection, the second end having a different cross-section than the first end and defining a first retention feature.

Clause 33: The attachment apparatus of Clause 32, wherein the second end is movable between a compressed state and an expanded state, the second end moved into the compressed state when the first projection passes through the second member and moved into the expanded state after passing through the second member.

Clause 34: The attachment apparatus of Clause 32, wherein the second end is biased into the expanded state.

Clause 35: The attachment apparatus of Clause 32, wherein the second member is disposed between the first end of the first projection and the second end of the first projection in the attached state.

Clause 36: The attachment apparatus of Clause 32, wherein the cross-section of the second end of the first projection includes at least one of a different size and shape than the first end of the first projection.

Clause 37: The attachment apparatus of any of the preceding clauses, wherein the second member includes a second retention feature having an opening and at least one tab extending into the opening, the opening receiving a portion of the first member therein when the second member is in the attached state.

Clause 38: The attachment apparatus of Clause 37, wherein the flexible material is disposed between the portion of the first member and the at least one tab when the second member is in the attached state.

Clause 39: The attachment apparatus of any of the preceding clauses, wherein the first member includes an opening extending between the first surface and the second surface, the opening operable to expose a portion of the device when the device is disposed within the void.

Clause 40: An attachment apparatus for selectively attaching a device to a flexible material, the attachment apparatus comprising a first member having a first wall including a first surface and a second surface formed on an opposite side of the first wall than the first surface, a second member selectively attached to the first member in an attached state to connect the second member to the first member and to the flexible material, the flexible material being disposed between the second member and the first member when the second member is in the attached state, and a void formed between the second surface of the first wall and the flexible material when the second member is in the attached state and operable to receive the device therein, the first member operable to support the device within the void between the second surface of the first member and the flexible material when the second member is in the attached state.

Clause 41: The attachment apparatus of any of Clause 40, wherein the first member is disposed on an opposite side of the flexible material than the second member when the second member is in the attached state.

Clause 42: The attachment apparatus of any of the preceding clauses, wherein the first member includes at least one positioning feature operable to position the device relative to the first member when the second member is in the attached state.

Clause 43: The attachment apparatus of Clause 42, wherein the at least one positioning feature includes a tab extending from the second surface of the first member and operable to engage the device to urge the device toward the flexible material.

Clause 44: The attachment apparatus of any of the preceding clauses, wherein the first member includes a first projection extending from the second surface, the first projection including a first end attached to the first member and a second end disposed at a distal end of the first projection, the second end having a different cross-section than the first end and defining a first retention feature.

Clause 45: The attachment apparatus of Clause 44, wherein the second end is movable between a compressed state and an expanded state, the second end moved into the compressed state when the first projection passes through the second member and moved into the expanded state after passing through the second member.

Clause 46: The attachment apparatus of Clause 44, wherein the second end is biased into the expanded state.

Clause 47: The attachment apparatus of Clause 44, wherein the second member is disposed between the first end of the first projection and the second end of the first projection in the attached state.

Clause 48: The attachment apparatus of Clause 44, wherein the cross-section of the second end of the first projection includes at least one of a different size and shape than the first end of the first projection.

Clause 49: The attachment apparatus of any of the preceding clauses, wherein the second member includes a second retention feature having an opening and at least one tab extending into the opening, the opening receiving a portion of the first member therein when the second member is in the attached state.

Clause 50: The attachment apparatus of Clause 49, wherein the flexible material is disposed between the portion of the first member and the at least one tab when the second member is in the attached state.

Clause 51: The attachment apparatus of any of the preceding clauses, wherein the first member includes an opening extending between the first surface and the second surface, the opening operable to expose a portion of the device when the device is disposed within the void.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An attachment apparatus for selectively attaching a device to a flexible material, the attachment apparatus comprising:

a first member having (i) a first wall defining a first opening and including a first surface and a second surface formed on an opposite side of the first wall than the first surface, (ii) a second wall extending from the second surface of the first wall to an engagement surface, and (iii) a first projection extending from the engagement surface in a direction away from the second surface and including a first retention feature; and a second member having a second retention feature selectively attached to the first retention feature in an attached state to connect the second member to the first member and to the flexible material, the attachment apparatus operable to form a void between the second surface of the first wall and the flexible material when the second member is in the attached state and operable to receive the device therein, the first member operable to support the device within the void between the second surface of the first member and the flexible material when the second member is in the attached state.

2. The attachment apparatus of claim 1, wherein the first projection is operable to extend a portion of the flexible material into the second member in the attached state.

3. The attachment apparatus of claim 1, wherein the first member includes at least one positioning feature operable to position the device relative to the first opening when the second member is in the attached state.

4. The attachment apparatus of claim 3, wherein the at least one positioning feature includes a tab extending from the second surface of the first member and operable to engage the device to urge the device toward the flexible material.

5. The attachment apparatus of claim 1, wherein the first projection includes a first end attached to the first member and a second end disposed at a distal end of the first projection, the second end having a different cross-section than the first end and defining the first retention feature.

6. The attachment apparatus of claim 5, wherein the second end is movable between a compressed state and an expanded state, the second end moved into the compressed state when the first projection passes through the second member and moved into the expanded state after passing through the second member.

7. The attachment apparatus of claim 6, wherein the second end is biased into the expanded state.

8. The attachment apparatus of claim 5, wherein the second member is disposed between the first end of the first projection and the second end of the first projection in the attached state.

9. The attachment apparatus of claim 5, wherein the cross-section of the second end of the first projection includes at least one of a different size and shape than the first end of the first projection.

10. The attachment apparatus of claim 1, wherein the first member is disposed on an opposite side of the flexible material than the second member when the second member is in the attached state.

11. The attachment apparatus of claim 1, wherein the second retention feature includes a second opening and at least one tab extending into the second opening, the second opening receiving the first projection therein in the attached state.

12. The attachment apparatus of claim 11, wherein the at least one tab engages the first retention feature in the attached state to maintain the second member in the attached state.

13. The attachment apparatus of claim 11, wherein the flexible material is disposed between the first projection and the at least one tab when the second member is in the attached state.

14. The attachment apparatus of claim 1, further comprising a second projection extending in a direction away from the second surface, the second projection operable to be attached to another second member in an attached state to secure the first member to the flexible material.

15. An attachment apparatus for selectively attaching a device to a flexible material, the attachment apparatus comprising:

a first member having a first wall including a first surface and a second surface formed on an opposite side of the first wall than the first surface and a second wall extending from the second surface to an engagement surface spaced apart from the second surface;

a second member selectively attached to the first member at the engagement surface in an attached state to connect the second member to the first member and to the flexible material; and the attachment apparatus operable to define a void bounded by the second surface of the first wall, the second wall, and the flexible material when the second member is in the attached state and the engagement surface is in contact with the flexible material, the first member operable to support the device within the void when the second member is in the attached state.

16. The attachment apparatus of claim 15, wherein the first member positions a portion of the flexible material within the second member when the second member is in the attached state to attach the first member and the second member to the flexible material.

17. The attachment apparatus of claim 15, wherein the first member includes at least one positioning feature operable to position the device relative to the first member when the second member is in the attached state.

18. The attachment apparatus of claim 17, wherein the at least one positioning feature includes a tab extending from the second surface of the first member and operable to engage the device to urge the device toward the flexible material.

19. The attachment apparatus of claim 15, wherein the first member includes a first projection extending from the second surface, the first projection including a first end attached to the first member and a second end disposed at a distal end of the first projection, the second end having a different cross-section than the first end and defining a first retention feature.

20. The attachment apparatus of claim 19, wherein the second end is movable between a compressed state and an expanded state, the second end moved into the compressed state when the first projection passes through the second member and moved into the expanded state after passing through the second member.

21. The attachment apparatus of claim 20, wherein the second end is biased into the expanded state.

22. The attachment apparatus of claim 19, wherein the second member is disposed between the first end of the first projection and the second end of the first projection in the attached state.

23. The attachment apparatus of claim 19, wherein the cross-section of the second end of the first projection includes at least one of a different size and shape than the first end of the first projection.

24. The attachment apparatus of claim 15, wherein the first member is disposed on an opposite side of the flexible material than the second member when the second member is in the attached state.

25. The attachment apparatus of claim 15, wherein the second member includes a second retention feature having an opening and at least one tab extending into the opening, the opening receiving a portion of the first member therein when the second member is in the attached state.

26. The attachment apparatus of claim 25, wherein the flexible material is disposed between the portion of the first member and the at least one tab when the second member is in the attached state.

27. The attachment apparatus of claim 15, wherein the first member includes an opening extending between the first surface and the second surface, the opening operable to expose a portion of the device when the device is disposed within the void.

* * * * *